United States Patent [19]

Tunnicliffe et al.

[11] Patent Number: 4,604,831

[45] Date of Patent: Aug. 12, 1986

[54] REDUCTION OF DRAUGHTS THROUGH SLIDING SASH WINDOWS

[75] Inventors: Robert W. Tunnicliffe, Harrogate; John M. H. Leighton, Thirsk, both of England

[73] Assignee: Ventrolla Limited, North Yorkshire, England

[21] Appl. No.: 600,329

[22] Filed: Apr. 13, 1984

[30] Foreign Application Priority Data

Apr. 15, 1983 [GB] United Kingdom ..... 8310299

[51] Int. Cl.[4] ..... E05D 15/16

[52] U.S. Cl. ..... 49/434; 49/404; 49/489

[58] Field of Search ..... 49/489, 404, 434, 435

[56] References Cited

U.S. PATENT DOCUMENTS

| | | | |
|---|---|---|---|
| 1,715,909 | 6/1929 | Ehrsam | 49/434 X |
| 2,132,748 | 10/1938 | Mohun | 189/72 |
| 2,659,112 | 11/1953 | Tornabene | 20/49 |
| 2,798,578 | 7/1957 | Toth | 49/489 X |
| 2,801,450 | 8/1957 | Funke | 49/489 |
| 3,130,456 | 4/1964 | Mingneault | 20/52 |
| 3,328,919 | 7/1967 | Beasley et al. | 49/434 |
| 3,420,002 | 1/1969 | Kondolf | 49/440 |
| 4,151,682 | 5/1979 | Schmidt | 49/404 |

FOREIGN PATENT DOCUMENTS

| | | |
|---|---|---|
| 500837 | 2/1939 | United Kingdom . |
| 566039 | 12/1944 | United Kingdom . |
| 2049772 | 12/1980 | United Kingdom . |

*Primary Examiner*—Kenneth Downey

*Attorney, Agent, or Firm*—Leydig, Voit & Mayer, Ltd.

[57] ABSTRACT

Vertical and horizontal sliding sash windows have two parallel but spaced leaves which slide in respective portions of the window opening. The portions are separated by a parting bead which extends around the window opening. Draught between the parting bead and the window leaves is reduced by the provision of seals between the parting bead and the window surfaces. These are formed by pile weatherstrips carried either on a replacement parting bead formed in one or two pieces. The remainder of the window is also sealed for the reduction of draughts.

6 Claims, 10 Drawing Figures

REDUCTION OF DRAUGHTS THROUGH SLIDING SASH WINDOWS

BACKGROUND TO THE INVENTION

The invention relates to the reduction of draughts through vertical or horizontal sliding sash windows.

In such windows, the leaves slide in respective vertical planes being guided in respective side-by-side portions of the frame opening which are separated by a parting bead. Such windows present a particular problem from the point of view of draught exclusion because the necessity to slide precludes the leaves being a tight fit in the frame; they must have a degree of free movement. In addition, there is the problem of positioning any seals correctly relatively to the leaves.

SUMMARY OF THE INVENTION

According to a first aspect of the invention, there is provided a method of reducing draughts through sliding sash windows in which the leaves slide in respective side-by-side portions of the frame opening, the portions being separated by a parting bead lying in a plane parallel to the planes of the leaves, the method comprising providing a parting bead which carries a seal or seals for engagement with the leaves to thereby reduce or prevent the passage of air between the parting bead and the leaves.

According to a second aspect of the invention, there is provided a replacement parting bead for use in the method of the first aspect of the invention, and comprising a base edge for fitting in a slot left on removal of an existing parting bead and one or more seal carriers at a position on the parting bead spaced from the base edge.

BRIEF DESCRIPTION OF THE DRAWINGS

The following is a more detailed description of some embodiments of the invention, by way of example, reference being made to the accompanying drawings in which.

DESCRIPTION OF THE PREFERRED EMBODIMENTS

Figure 1:
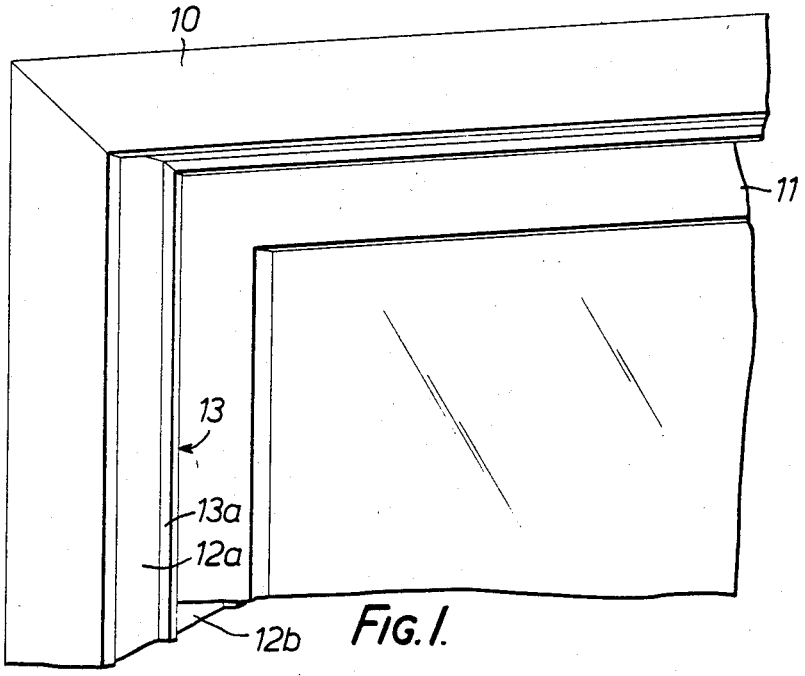
FIG. 1 is a perspective view of part of a vertical sliding sash window.

Referring first to FIG. 1, the vertical sliding sash window comprises a wooden frame 10 and two glazed sliding leaves one of which is shown at 11. The leaves slide in respective side-by-side portions 12*a*, 12*b* of the frame opening, the portions being separated by a wooden parting bead 13 lying in a plane parallel to the planes of the leaves and extending along the vertical sides of the opening and across the top of the opening. The parting bead 13 guides the leaves in their sliding movement and, in the closed position shown in FIG. 1, a face of each leaf engages or is adjacent to a side edge 13*a* of the parting bead 13. The parting beads 13 are fixed by nails in a slot formed around the opening.

Figure 2:
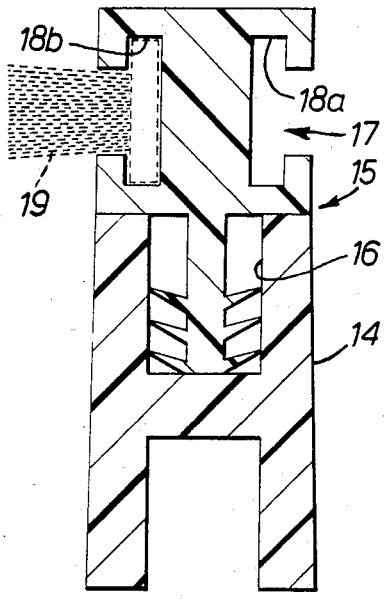
FIG. 2 is a cross-section of a two-piece replacement parting bead for insertion in a slot of the window of FIG. 1 and for carrying two seals.

In order to reduce draughts around the leaves and past the beads in such vertical sliding windows, one of two measures may be adopted. The first is shown in FIG. 2. In this case, the existing parting bead 13 is removed to leave a slot extending around the window opening. A base edge strip 14 of a two-piece replacement parting bead 15 is then inserted into the slot. The base edge strip 14 is of generally H-shaped cross-section to form two grooves 16 leading from opposite edges of the strip. The sides of the base edge strip 14 diverge from one edge to the other so that the strip 15 can fit two slots of differing widths; for example 7 or 8 mm slots. It will be appreciated that the strip may, however, be of constant width to fit a slot of a single width; for example, a 7 mm slot or an 8 mm slot or a 12 mm slot. The base edge strip 14 is formed from any suitable plastics material and is fixed in the slot by any suitable means, for example by screws or pins passing through the base of the grooves 16.

The second part of the replacement parting bead 15 is formed by a seal carrying strip 17 which has a root which is inserted into the upper groove 16. The strip is formed with two oppositely facing channels 18*a*, 18*b* for receiving respective pile weatherstrips, one of which is shown in dotted line at 19. With the weatherstrips in position, each side face of the parting bead is thus provided with a seal which engages the adjacent surface of the associated leaf to prevent draughts passing between the leaf and the parting bead. The weatherstrips 19 will also cushion the leaves, so preventing rattling, noise and dust.

Figure 3:
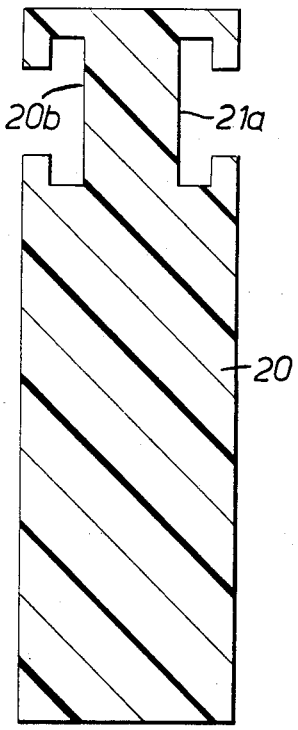
FIG. 3 is a cross-sectional view of a one-piece replacement parting bead for insertion in a slot of the window of FIG. 1 and for carrying two seals.

An alternative method will now be described with reference to FIG. 3. In this method, the original parting bead 13 is removed and a one-piece replacement parting bead 20 is inserted in its place. The replacement parting bead has a base edge which is received in the slot left on removal of the original parting bead 13 and an uper edge formed with two oppositely facing grooves 21*a*, 21*b* for receiving pile weatherstrip in the same way as the grooves 18*a* and 18*b* of the strip 17 described above with reference to the FIG. 2. Thus in this way also, respective seals are provided between the parting bead side surfaces and the associated faces of the window leaves.

Figure 4:
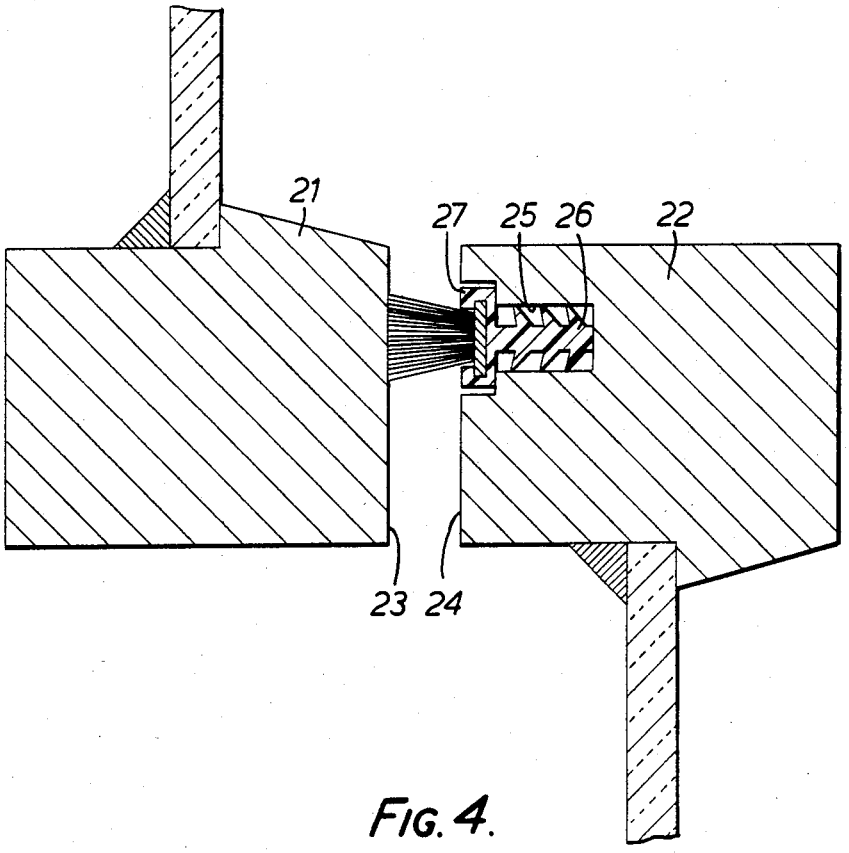
FIG. 4 is a cross-section through two leaves of the window of FIG. 1 at the centre of the window and with the leaves closed so that respective horizontal members of the leaves are aligned.

The remainder of the window is dealt with in the following way. At the meeting point between the lower horizontal member 21 of the upper leaf and the upper horizontal member 22 of the lower leaf (see FIG. 4), a seal is provided on the vertical surface 24 of the member 22 of the lower leaf. A T-section groove 25 is cut normal to the surface 24 and a root 26 of a pile carrier 27 is inserted into the base of groove 25 with the remainder of the carrier 27 being recessed into the head of the groove 25. A pile weatherstrip 28 is inserted into the carrier 27 and engages with the opposite vertical surface 23 of the upper leaf to form a seal therewith.

In some sash windows, the surfaces 23, 24 are angled to the vertical by equal amounts, but in opposite senses so that they remain parallel. In this case (not shown), the groove 25 is still cut normal to the surface 24, so that the pile still extends normal to both surfaces 23, 24.

Figure 5A:
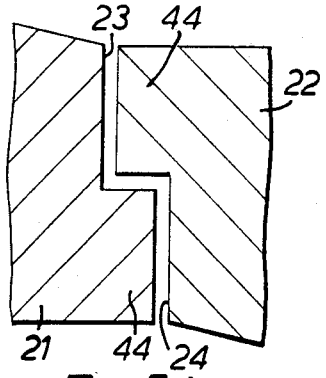
FIG. 5A is a similar view to FIG. 4 but showing an alternative configuration of the horizontal members, with beads being mounted on the members.

Referring next to FIG. 5A, a common alternative configuration of the horizontal members 21, 22 is one in which beads 44 are formed on the vertical faces 23, 24 to reduce air flow between the members 21, 22 by defining a labarinth path between them. These beads 44 may either be formed integrally with the associated horizontal member 21, 22 or be formed separately and nailed to the associated member 21, 22.

Figure 5B:
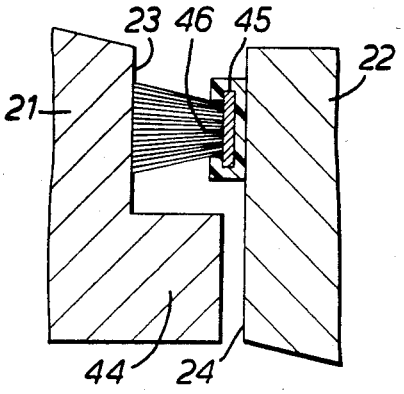
FIG. 5B is a similar view to FIG. 5A showing one way of mounting a pile weatherstrip on one of the horizontal members.
Figure 5C:
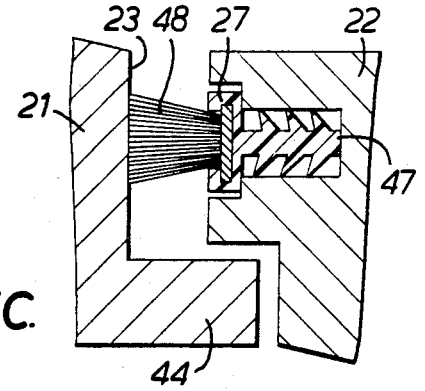
FIG. 5C is a similar view to FIG. 5A showing a second way of mounting a pile weatherstrip on one of the horizontal members.

These two cases are dealt with differently, as follows. Where the beads 44 are separately formed (see FIG. 5B), the bead 44 on the lower leaf is removed. A carrier strip 45, formed with a channel on one side and a flat base on the other side, is nailed in place of the bead 44. A pile weatherstrip 46 is inserted into the carrier channel to engage with the other vertical surface 23.

Where the beads 44 are formed integrally (see FIG. 5C), the beads are left in position. A channel 47 is cut in the vertical surface of the bead 44 on the horizontal member 22 of the lower leaf and a pile carrier 27 of the kind described above with reference to FIG. 4, is inserted into the channel 47. A pile weatherstrip 48 is inserted into the carrier 27 and engages the other vertical surface 23.

Figure 6:
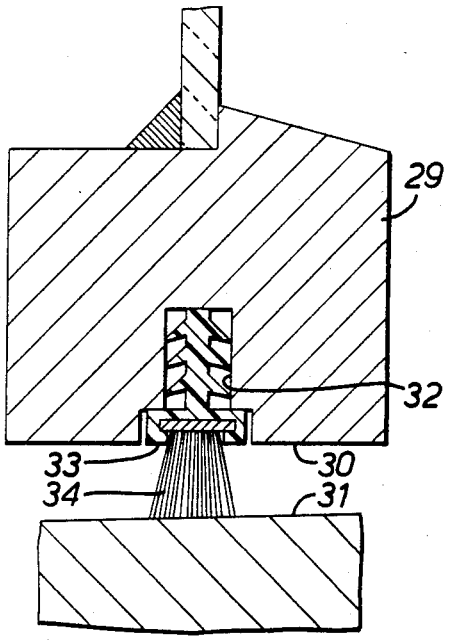
FIG. 6 is a vertical cross-section through a lower of the leaves of the window of FIG. 1 at a lower horizontal member of the lower leaf.

At the lower member 29 of the lower leaf (see FIG. 6), a seal is provided between the lower surface 30 of this member and the sill 31. A T-section groove 32 is cut in the lower surface 30, normal thereto, and a root of a pile carrier 33 is inserted into the base of the groove 32 with the remainder of the carrier 33 being recessed into the head of the groove 32. A pile weatherstrip 34 is inserted into the carrier 27 and engages with the adjacent sill 31 to form the seal.

In this way, the window is sealed against draughts around the whole perimeter of each leaf. In addition, the leaves are cushioned against rattling. The seals can be readily inserted in an existing window and can readily be removed for painting.

Although the specific embodiment described above is a vertical sliding sash window, it will be appreciated that a similar technique can be used for horizontal sliding sash windows. The parting bead can be dealt with exactly as described above. The gap where the two leaves overlap will be dealt with in the same way, except that the facing vertical surfaces will be on vertical members and not horizontal members. The two lower members will be fitted with weatherstrips in the same way as the lower member 29 of the lower leaf in the vertical sliding sash window.

When a sash window treated in this way, is painted, it is important that paint does not reach the pile because this will reduce its effectiveness as a seal. In order to prevent this, a simple U-shaped plastics member may be provided which fits over and covers the parting bead and the pile weatherstrip to protect them from paint. Of course, the pile weatherstrip can be easily removed and replaced, as required.

When wooden sash windows are new, the sashes can be moved relatively easily in the associated channels to open and close the windows. As time passes, however, the wood shrinks and becomes roughened and this can lead to difficulties. The sashes can twist in their own plane so that opposed upper and lower corners of the sash jam in the channel. In addition, the sash can tilt backwards or forwards which can also lead to jamming.

In order to mitigate or overcome these problems, further pile weatherstripping can be arranged between the remaining sides of the sashes and the remaining sides of the channels to provide low friction surfaces on which the sash can slide. This may be done in either of the following ways.

Figure 7:
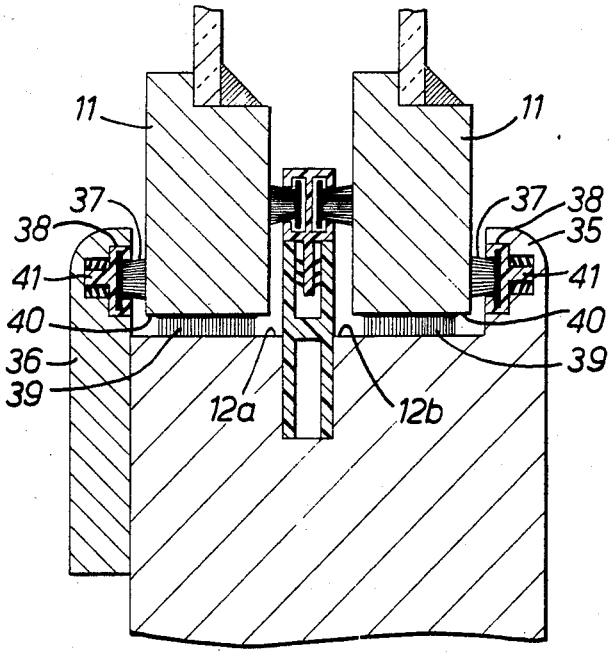
FIG. 7 is a horizontal cross-section through one side of the window of FIG. 1 with the leaves overlapping and showing one arrangement for reducing friction between the leaves and the frame.

Referring first to FIG. 7, in one embodiment shaped channels 38 are cut in a box frame moulding 35 and a staff bead 36 which form the outer edges of the leaf-receiving channels 12*a*, 12*b* of the sash. Plastics pile carriers 41 are inserted into these channels 38 and pile weatherstrip 37 is inserted into the carriers 41 to engage with the associated faces of the leaves 11.

Pads of pile weatherstrip are attached, for example, by gluing, to the edges 40 of the leaves 11; pads 39 preferably being provided at the upper and lower ends of these edges, although a continuous strip may be provided extending from the top to the bottom of the edge. These pads 39 engage the bases 12*a*, 12*b* of the associated channels and provide further low friction sliding surfaces for the leaves 11. Pads 39 of pile weatherstrip can, however, be located at any convenient point on the edges of the leaves. Desirable locations may be determined by observing where in particular the edge has worn against the associated channel.

Figure 8:
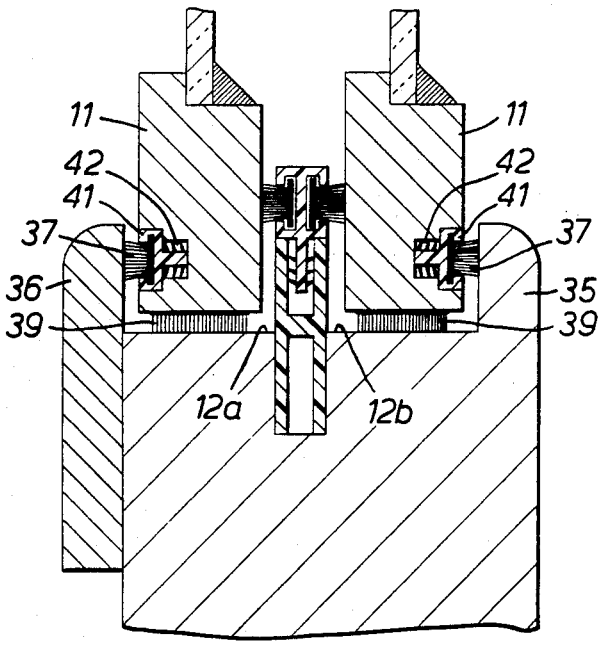
FIG. 8 is a similar view to FIG. 6 but showing an alternative arrangement for reducing friction between the leaves and the frame.

Referring next to FIG. 8, in the second embodiment, the arrangement is similar to that described above with reference to FIG. 6 but the seal between the outer faces of the leaves and the box frame moulding 35 and the staff bead 36 are formed by pile weatherstrip 37 carried in plastics pile carriers 41 received in channels 42 formed in the faces of the leaves 11.

It will be appreciated that it is not necessary to provide all the pile weatherstrips described above with reference to FIGS. 6 and 7 of the drawings. The pads, or just one of the side weatherstrips will provide an appreciable reduction in the frictional forces inhibiting sliding of the sashes.

It has been found that this arrangement, as well as providing easy opening and closing of the sashes, also reduces considerably the transmission of noise around the sashes. The arrangement also provides draught-proofing of the window.

We claim:

1. A method of reducing draughts through sliding sash windows in which wooden leaves slides in respective side-by-side portions of a wooden frame opening, the portions being separated by a parting bead carried in a slot extending around the frame and lying in a plane parallel to the plan of the leaves, the method comprising:

removing the parting bead to leave said slot, securing in said slot, an H-shaped base edge strip including means defining a groove, inserting a seal carrying strip into said means defining a groove, said seal carrying strip defining two oppositely facing channels, and introducing respective pile weatherstrips into said oppositely facing channels, so that each pile weatherstrip seals against a respective leaf to reduce draughts past the leaves.

2. A method according to claim 1 and further comprising cutting a groove in one of two adjacent vertical surfaces of those members of the leaves which are aligned, when the leaves are closed, fixing in said groove a mounting including a channel and then inserting a pile weatherstrip in said channel to engage with the other of said two adjacent vertical surfaces.

3. A method according to claim 1 and comprising cutting a groove in at least one lower horizontal member of at least one leaf, fixing in said groove a mounting including a channel and then inserting a pile weatherstrip into said channel to engage with an adjacent surface of the frame opening.

4. A method according to claim 1 and in which the leaf-receiving portions of the frame opening comprise two side-by-side channels separated by the parting bead, which also forms one edge of each channel, each channel also including a second edge and a base extending between the edges, the method further comprising providing pile weatherstrip between each leaf and at least one of the second edge and the base of each channel.

5. A replacement parting bead for use in the method of claim 1, and comprising an H-shaped base edge strip forming two grooves leading from opposite edges of the base edge strip and for fitting in a slot left on removal of an existing parting bead and a seal carrying strip including a root which is removably engageable with one of said two grooves of the H-shaped base strip to form a replacement parting bead, the carrying strip including two oppositely facing channels receiving respective pile weatherstrips.

6. A parting bead according to claim 5, wherein the H-shaped base strip has two spaced sides forming limbs of the H, said sides of the strip diverging from one edge to the other so that the width of the strip at one edge is smaller than the width of the strip at the other for fitting slots of two differing widths.

* * * * *